US007717154B2

(12) United States Patent
Cheng

(10) Patent No.: US 7,717,154 B2
(45) Date of Patent: May 18, 2010

(54) WINDOW COVERINGS

(76) Inventor: Li-Ming Cheng, No. 215, Jiouru 1st Rd., Sanmin Dist., Kaohsiung City (TW)

( * ) Notice: Subject to any disclaimer, the term of this patent is extended or adjusted under 35 U.S.C. 154(b) by 294 days.

(21) Appl. No.: 11/821,123

(22) Filed: Jun. 22, 2007

(65) Prior Publication Data

US 2008/0314530 A1 Dec. 25, 2008

(51) Int. Cl.
*E06B 9/30* (2006.01)

(52) U.S. Cl. ..... 160/170; 160/84.04; 160/173 R

(58) Field of Classification Search ..... 160/170, 160/168.1 R, 173 R, 178.1 R, 178.2; 242/375.3, 242/384.7, 396.4; 254/359, 364
See application file for complete search history.

(56) References Cited

U.S. PATENT DOCUMENTS 5,890,529 A * 4/1999 Haarer ..... 160/319
6,029,734 A 2/2000 Wang et al.
6,129,131 A * 10/2000 Colson ..... 160/84.02
6,675,861 B2 1/2004 Palmer et al.
7,096,917 B2 * 8/2006 Ciuca et al. ..... 160/170
7,341,091 B2 * 3/2008 Nien et al. ..... 160/170
2008/0264576 A1 * 10/2008 Cheng ..... 160/168.1 V

* cited by examiner

*Primary Examiner*—Blair M. Johnson
(74) *Attorney, Agent, or Firm*—Muncy, Geissler, Olds & Lowe, PLLC.

(57) ABSTRACT

A window coverings includes an upper and a lower elongated members, a slat assembly, a first lift cord, a second lift cord and a lift cord retracting and releasing control means. The lift cord retracting and releasing control means is located at the upper elongated member and cooperative with the first and second lift cords to control movement of the slat assembly. The first lift cord has one end fastened to the lift cord retracting and releasing control means and other end threading through the upper elongated member. The second lift cord has one end fastened and wound around the lift cord retracting and releasing control means and threading through the upper elongated member. Through coupling relationship between the first and second lift cords and the lift cord retracting and releasing control means the slat assembly already rolled up or extended at a selected elevation can be altered to another elevation.

19 Claims, 18 Drawing Sheets

WINDOW COVERINGS

FIELD OF THE INVENTION

The present invention relates to a window coverings and particularly to an improved window coverings with a slat assembly adjustable to a selected elevation after retracted or extended.

BACKGROUND OF THE INVENTION

A conventional window coverings has a slat assembly which cannot be rolled up or lowered again after retracted or extended to further move the slat assembly separately and longitudinally to alter the elevation. As a result users cannot adjust the indoor luminary condition as desired. It still has problems such as not very practical, not stable operation and the like.

SUMMARY OF THE INVENTION

The present invention aims to provide an improved window coverings that allows a slat assembly already being retracted or extended by a first lift cord and a second lift cord to be moved longitudinally again at a desired elevation to facilitate adjustment of indoor luminary condition.

To achieve the foregoing object, the improved window coverings of the invention mainly includes an upper elongated member, a lower elongated member, a slat assembly, a first lift cord, a second lift cord and a lift cord retracting and releasing control means. The lift cord retracting and releasing control means is located at one side of the upper elongated member. The lower elongated member is spaced from the upper elongated member at a lower position. The slat assembly has a upper end and a lower end coupled respectively to the upper elongated member and the lower elongated member. The first lift cord has one end fastened to the lift cord retracting and releasing control means and other end threading through the upper elongated member. The second lift cord has one end wound around the lift cord retracting and releasing control means and threading through the upper elongated member.

By means of such a structure the following functions can be achieved: through the first lift cord, second lift cord and lift cord retracting and releasing control means, the slat assembly can be rolled up or extended downwards; then through the coupling relationship between the first lift cord and second lift cord and the lift cord retracting and releasing control means, the slat assembly can be further lifted or lowered for a selected distance; after the slat assembly is moved to the selected elevation it can be anchored through the lift cord retracting and releasing control means. Thus the elevation of the slat assembly can be altered to adjust the indoor luminary condition as desired.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
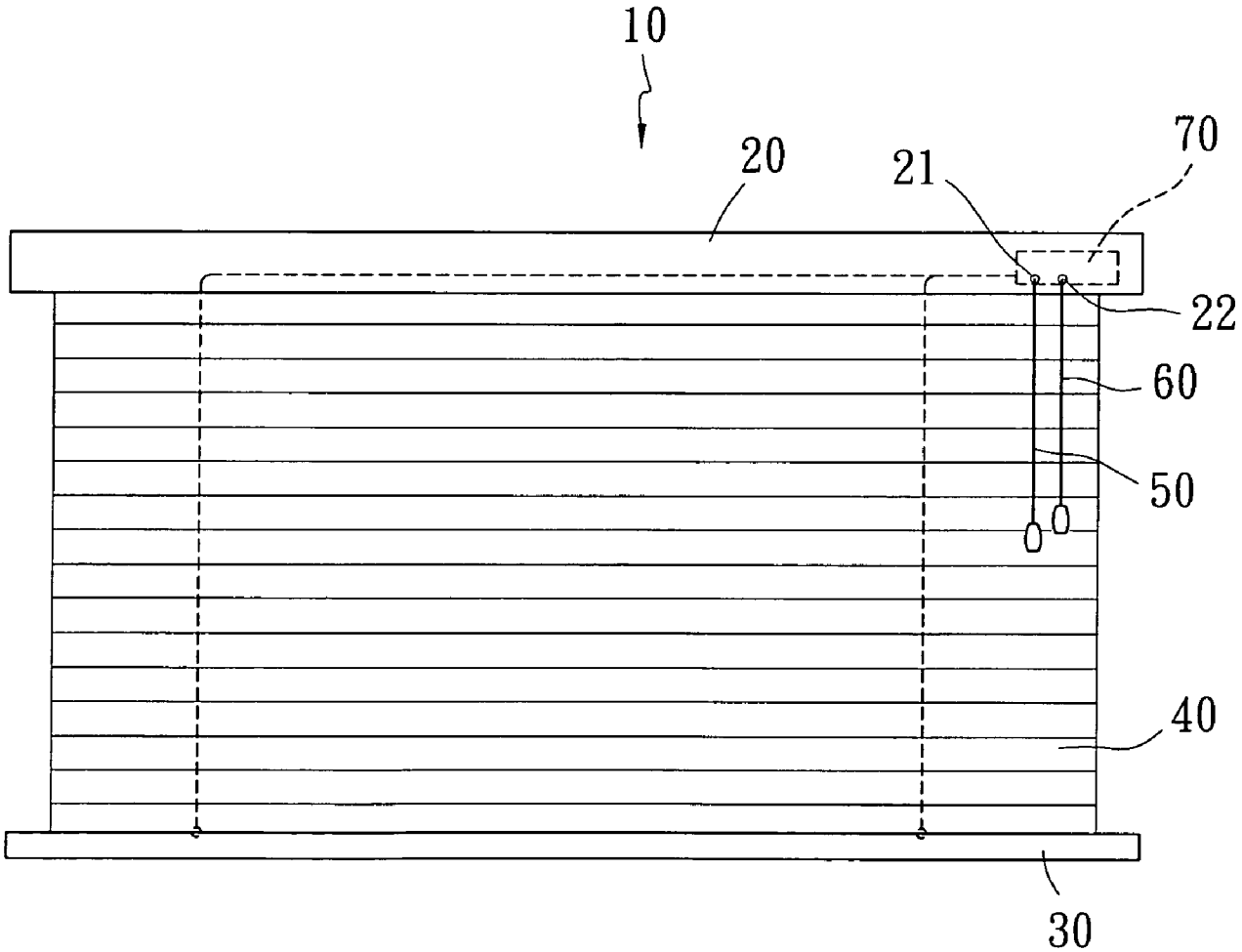
FIG. 1 is a front view of the invention.
Figure 2:
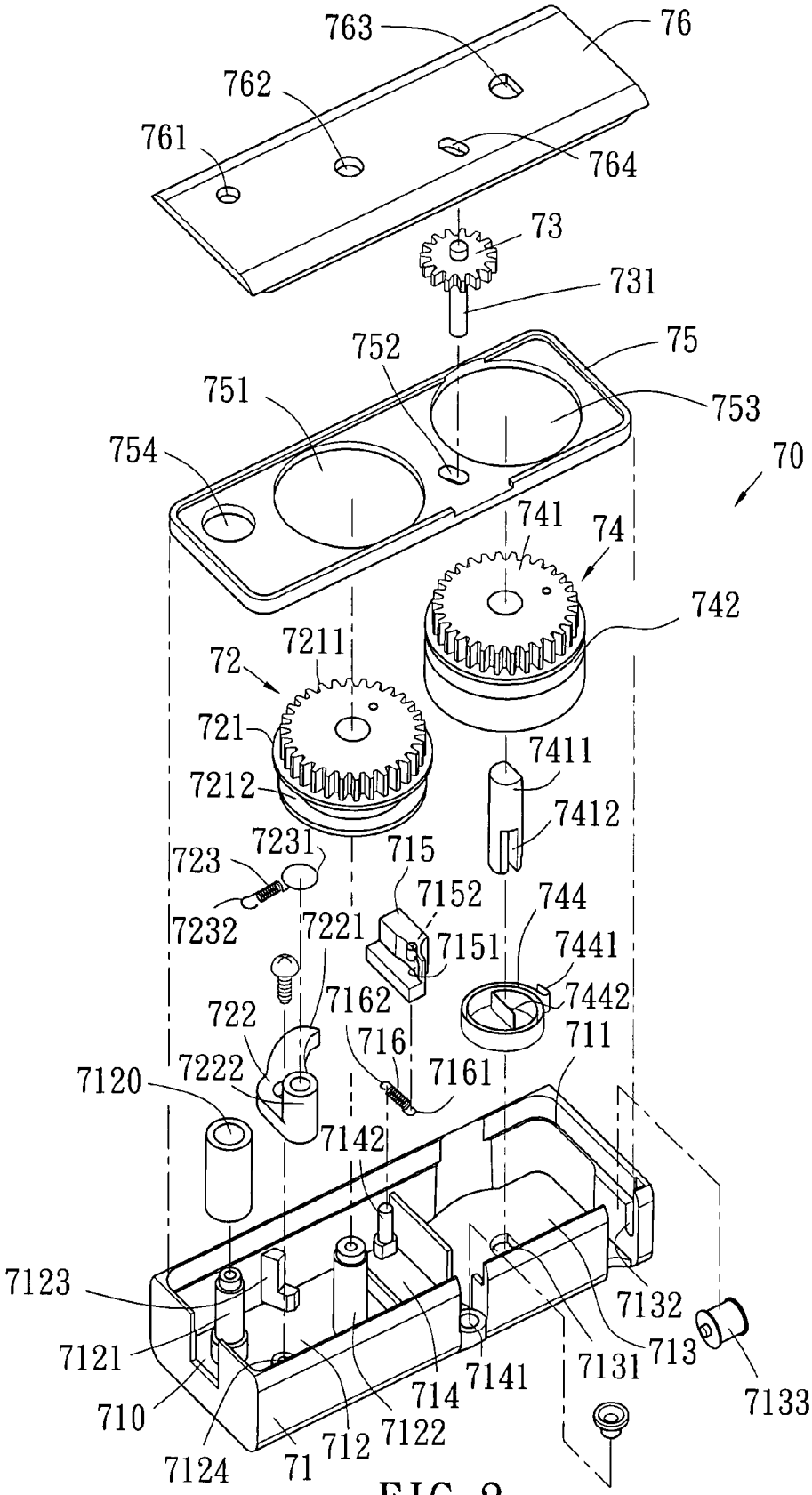
FIG. 2 is an exploded view of the lift cord retracting and releasing control means of the invention.

Please refer to FIG. 1, the window coverings 10 according to the invention mainly includes an upper elongated member 20, a lower elongated member 30, a slat assembly 40, a first lift cord 50, a second lift cord 60 and a lift cord retracting and releasing control means 70. The upper elongated member 20 has a trough the hold the lift cord retracting and releasing control means 70 which can wind and release the first lift cord 50 and the second lift cord 60. The upper elongated member 20 further has a plurality of openings running through the bottom such as a first opening 21 and a second opening 22 shown in the drawing.

The second elongated member 30 is spaced from the upper elongated member 20 at a lower position. The slat assembly 40 has a slat and lift cord means 80 which has a upper end and a lower end fastened respectively to the upper elongated member 20 and the lower elongated member 30. The first lift cord 50 has one end fastened to the lift cord retracting and releasing control means 70 and other end threading through the first opening 21 of the upper elongated member 20. The second lift cord 60 has one end fastened and wound around the lift cord retracting and releasing control means 70 and other end threading through the second opening 22 of the upper elongated member 20. Thereby through the first lift cord 50, second lift cord 60 and lift cord retracting and releasing control means 70 the slat assembly 40 can be steadily rolled up and extended downwards at a selected elevation.

Also referring to FIGS. 2 through 6, the first and second openings 21 and 22 are located on other side of the upper elongated member 20 opposing the lift cord retracting and releasing control means 70. The lift cord retracting and releasing control means 70 is located on an inner side of the first and second openings 21 and 22 to latch and anchor the first and second lift cords 50 and 60. The lift cord retracting and releasing control means 70 mainly includes a seat 71, a ratchet and gear set 72, a driving gear 73, an auxiliary gear set 74, an locating member 75 and an upper lid 76. The seat 71 is a box with a hollow upper portion and a notch 710 at one side to receive the lift cord means 80. The seat 71 further has a recess 711 on an upper end and the interior divided into a first housing compartment 712, a second housing compartment 713 and a housing space 714 formed between them. The first housing compartment 712 holds a spindle 7121 to couple with a roller 7120 and a shaft 7122, and a bucking member 7123 at an upper position, and an anchor post 7124 and a strut 7125 on a lower position. The second housing compartment 713 has a flat bottom which has an aperture 7131 formed thereon, and a directing trough 7132 at one corner opposing the aperture 7131. The directing trough 7132 is latched with a pulley 7133. The housing space 714 has a through hole 7141 at the bottom of one side and an anchor strut 7142 at another side, and a slant rectangular opening 7143 at the bottom to hold the driving spool 73. The housing space 714 further holds a movable element 715 which has an aperture 7151 at one end and a locating bar 7152 and a trough 7153 at the bottom end. The trough 7153 holds a spring 716 which has one end 7161 latched on the locating bar 7152 and other end 7162 coupled on the anchor strut 7142 so that the movable 715 is movable in the housing space 714 through the elastic force of the spring 716. The ratchet and gear set 72 is held in the first housing compartment 712, and includes at least a winding spool 721, a stopper 722 and an elastic element 723. The winding spool 721 is coupled on the shaft 7122 of the first housing compartment 712, and has a gear 7211 on an upper end, a winding trough 7212 at a middle portion and a ratchet spool 7213 at a lower end. The winding trough 7212 is wound by the lift cord means 80. The stopper 722 is pivotally coupled on the anchor post 7124 of the first housing compartment 712 and has a latch end 7221 at one end to form a latch condition with the ratchet spool 7213 and a boss 7222 at other end. The elastic element 723 has one end 7231 to latch on the boss 7222 and other end 7232 coupled on the strut 7125. Thereby the stopper 722 can be swiveled about an axis. The boss 7222 aims to anchor the first lift cord 50. When the boss 7222 is moved the latch end 7221 is moved in the opposite direction. The driving gear 73 has a first axle 731 run through the center that is movable in the slant rectangular opening 7143. The auxiliary gear set 74 is held in the second housing compartment 713 and has a gear 741 with a second axle 7411 run through the center. The second axle 7411 has a flat surface and a channel 7412 at one end. The second axle 7411 runs through the aperture 7131 of the second housing compartment 713. The gear 741 has a winding trough 742 at a middle portion to be wound by the second lift cord 60, and a groove 743 at a lower end to hold one end 7441 of an elastic element 744 and other end 7442 latched in the channel 7412 of the second axle 7411. The locating member 75 is coupled in the recess 711 and has a first coupling hole 751, a rectangular hole 752 and a second coupling hole 753 to receive respectively the ratchet and gear set 72, driving gear 73 and auxiliary gear set 74, and a coupling opening 754 at one side to hold the roller 7120. Thereby the locating member 75 is located on an upper position of the seat 71 to allow the ratchet and gear set 72 and the auxiliary gear set 74 to form a more secure coupling and positioning relationship. The upper lid 76 is located on an upper position of the seat 71 and has a plurality of openings formed thereon. As shown in the drawings, the openings includes a first opening 761, second opening 762, third opening 763 and rectangular opening 764 to be coupled with the spindle 7121, shaft 7122, second axle 7411 and first axle 731.

Figure 3:
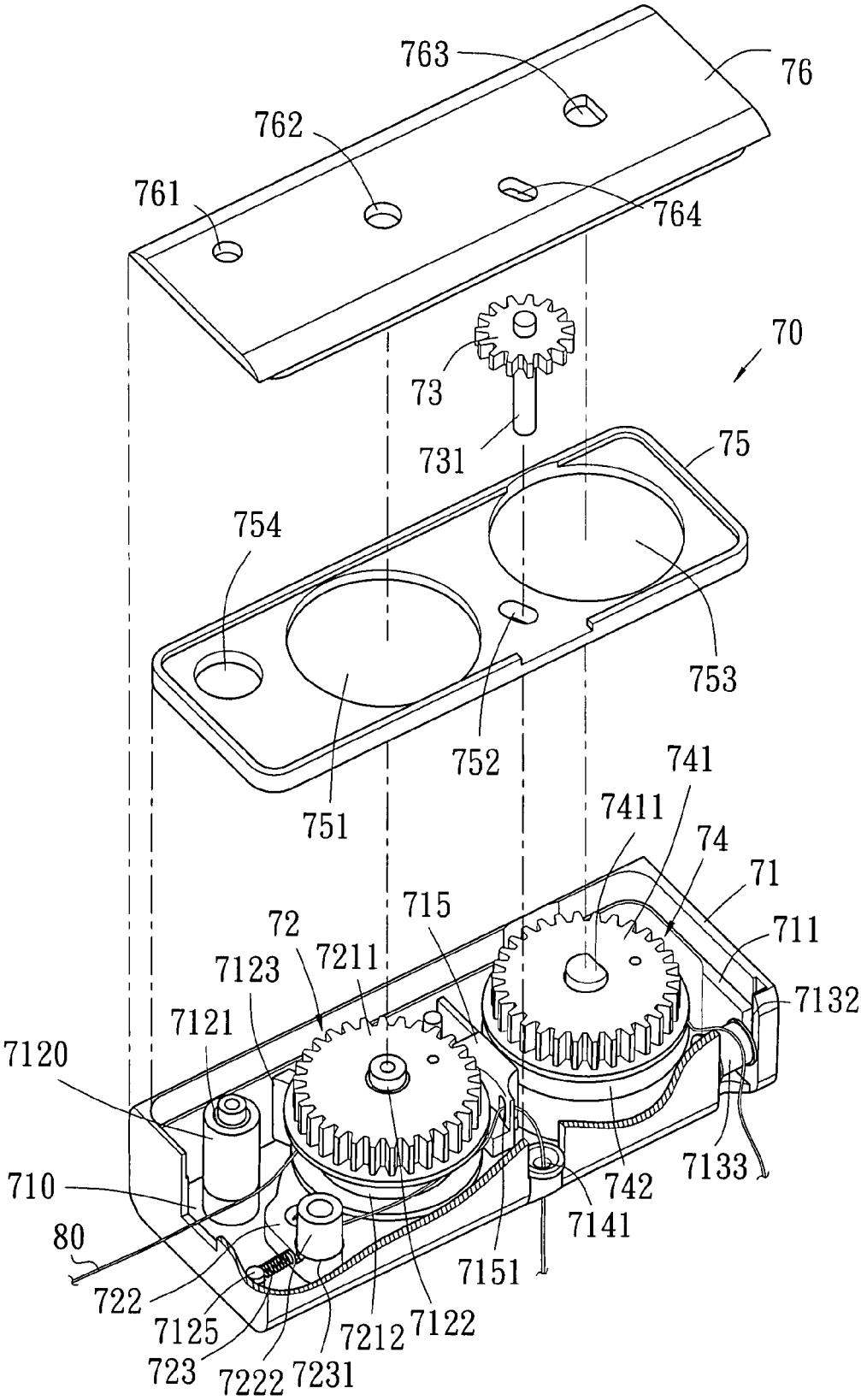
FIG. 3 is another exploded view of the lift cord retracting and releasing control means of the invention.

Also referring to FIG. 3, the lift cord retracting and releasing control means 70 is located on the upper elongated member 20 to control movement of the slat assembly 40 cooperative with the first and second lift cords 50 and 60. One end of the first lift cord 50 is fastened to the lift cord retracting and releasing control means 70 and other end threading through the first opening 21 of the upper elongated member 20. The second lift cord 60 has one end fastened and wound around the lift cord retracting and releasing control means 70 and threading through the second opening 22.

Figure 4:
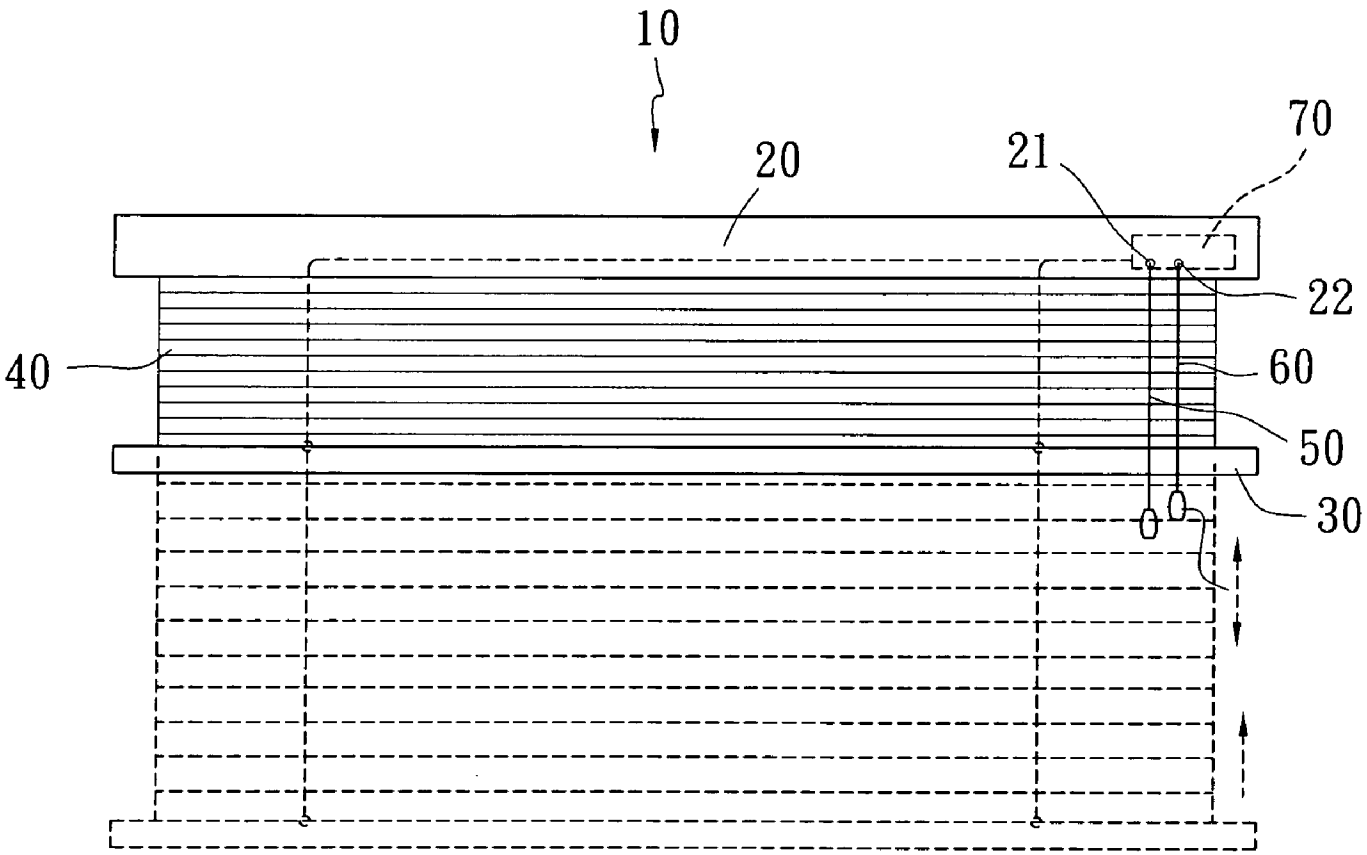
FIG. 4 is a schematic view of the invention showing the slat assembly retracted by the second lift cord.
Figure 5:
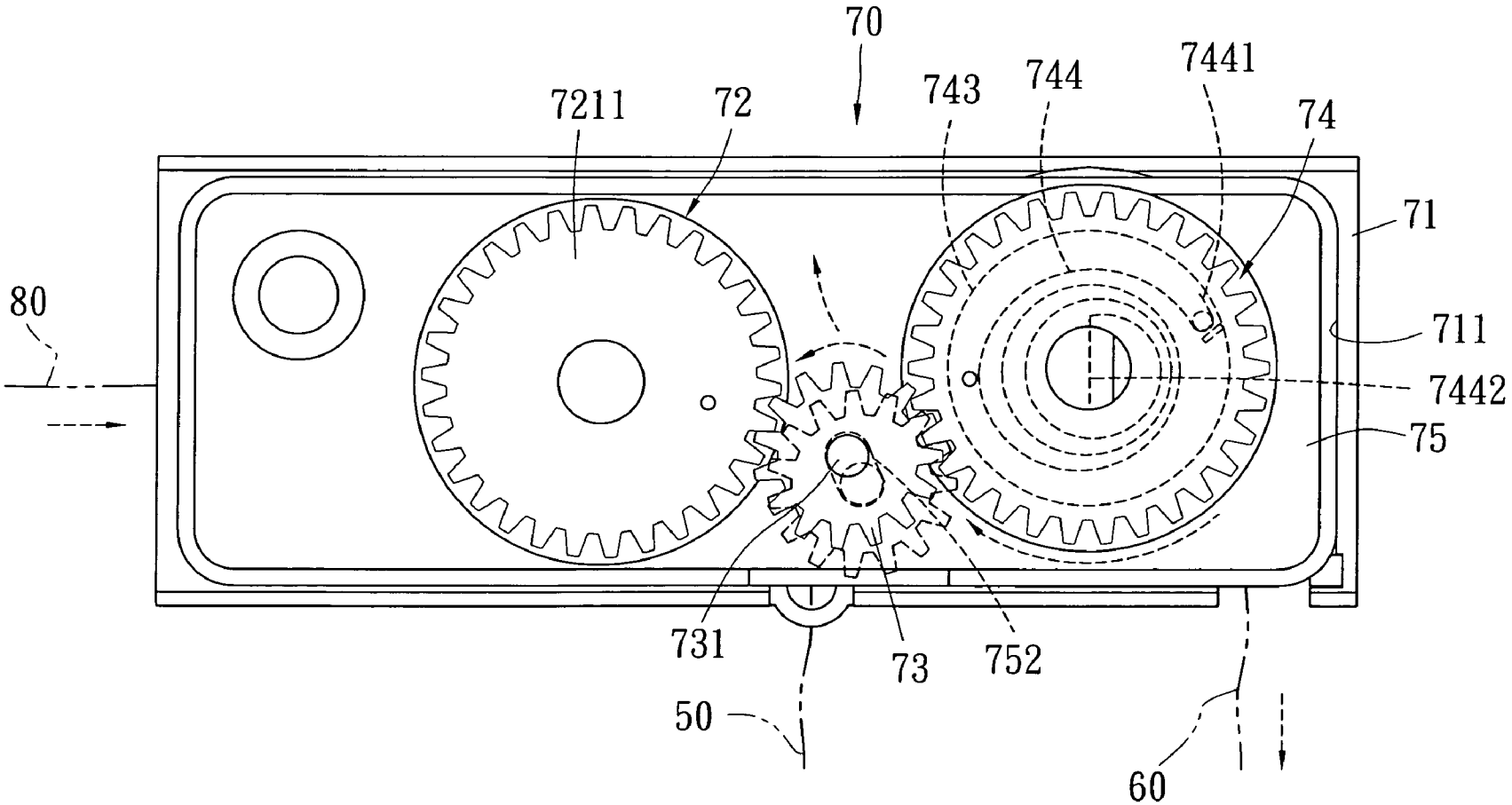
FIG. 5 is a top view of the lift cord retracting and releasing control means for retracting the slat assembly.
Figure 6:
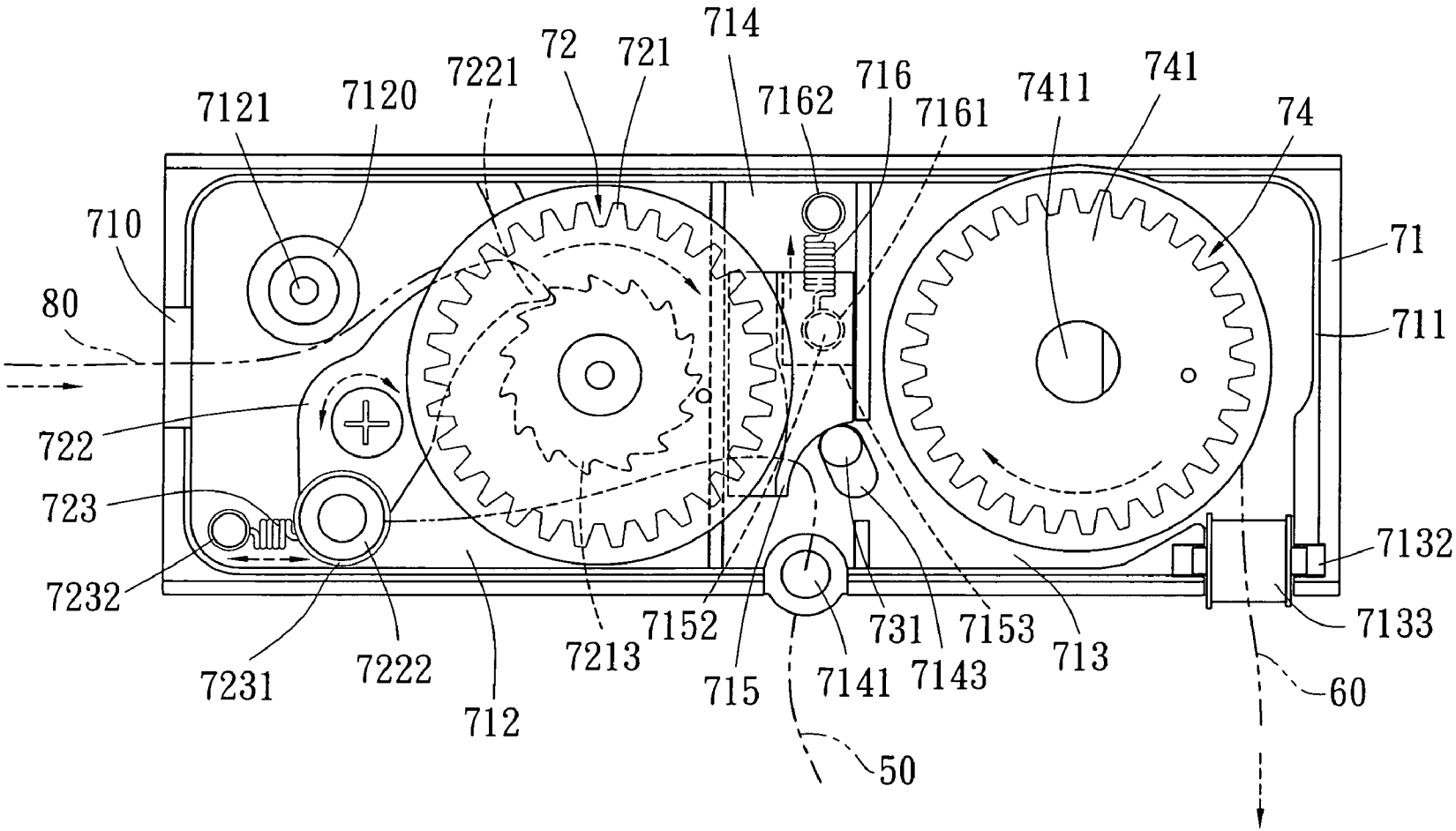
FIG. 6 is another top view of the lift cord retracting and releasing control means for retracting the slat assembly.

Also referring to FIGS. 4 and 5, when in use for the slat assembly 40 on the window coverings 10, pull the second lift cord 60 to move the auxiliary gear seat 74 so that the elastic element 744 at the bottom is wound; the auxiliary gear seat 74 rotates in the clockwise direction; the driving gear 73 also is turned and moved upwards to engage with the ratchet and gear set 72 so that the ratchet and gear set 72 rotates in the same direction as the auxiliary gear set 74 does. While the ratchet and gear set 72 rotates the winding trough 7212 on the winding spool 721 winds the lift cord means 80; the latch end 7221 of the stopper 722 latches on the ratchet spool 7213 at the lower end of the winding spool 721 (referring to FIG. 6), hence the slat assembly 40 is rolled upwards at a selected elevation. When the second lift cord 60 is pulled downwards continuously, the slat assembly 40 can be rolled up further again.

Figure 7:
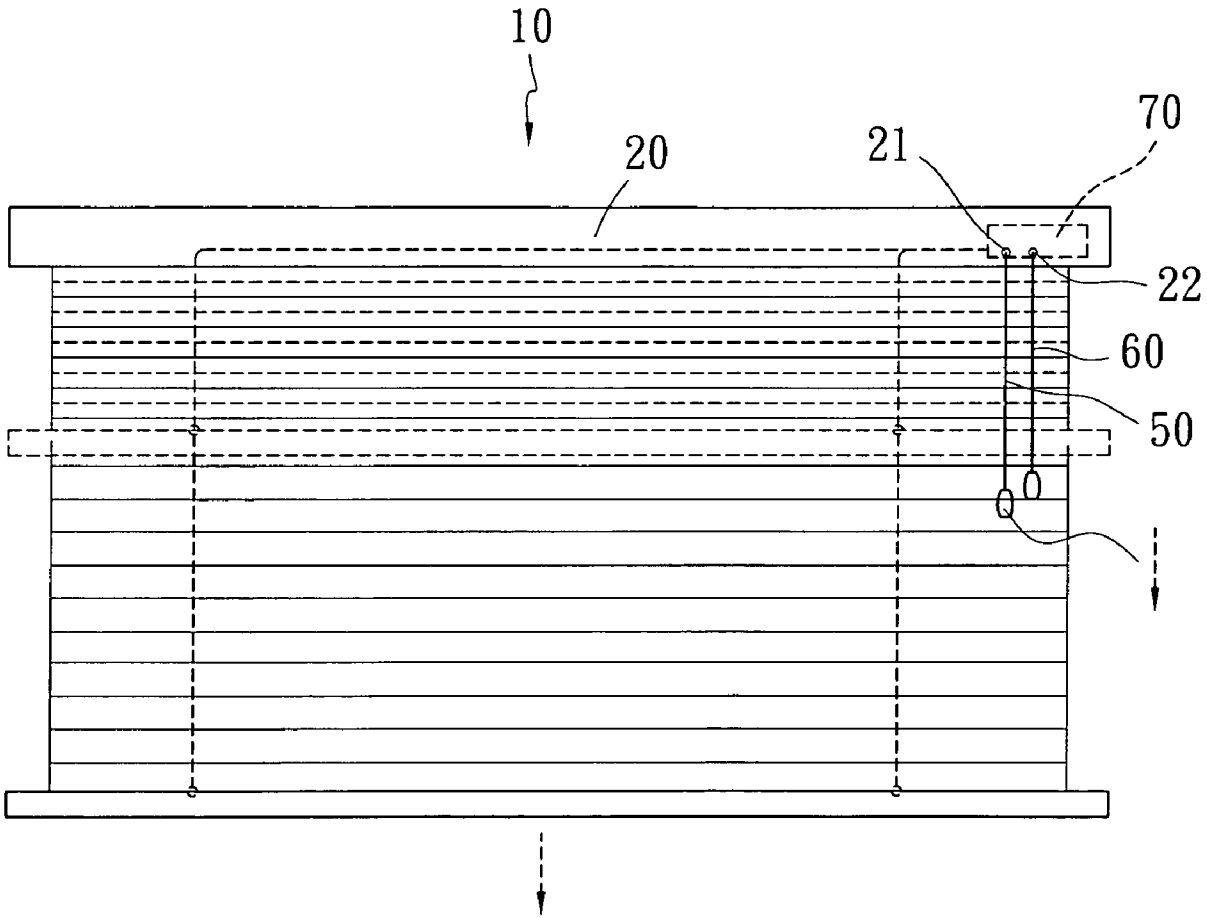
FIG. 7 is a schematic view of the invention showing the slat assembly released by the first lift cord.
Figure 8:
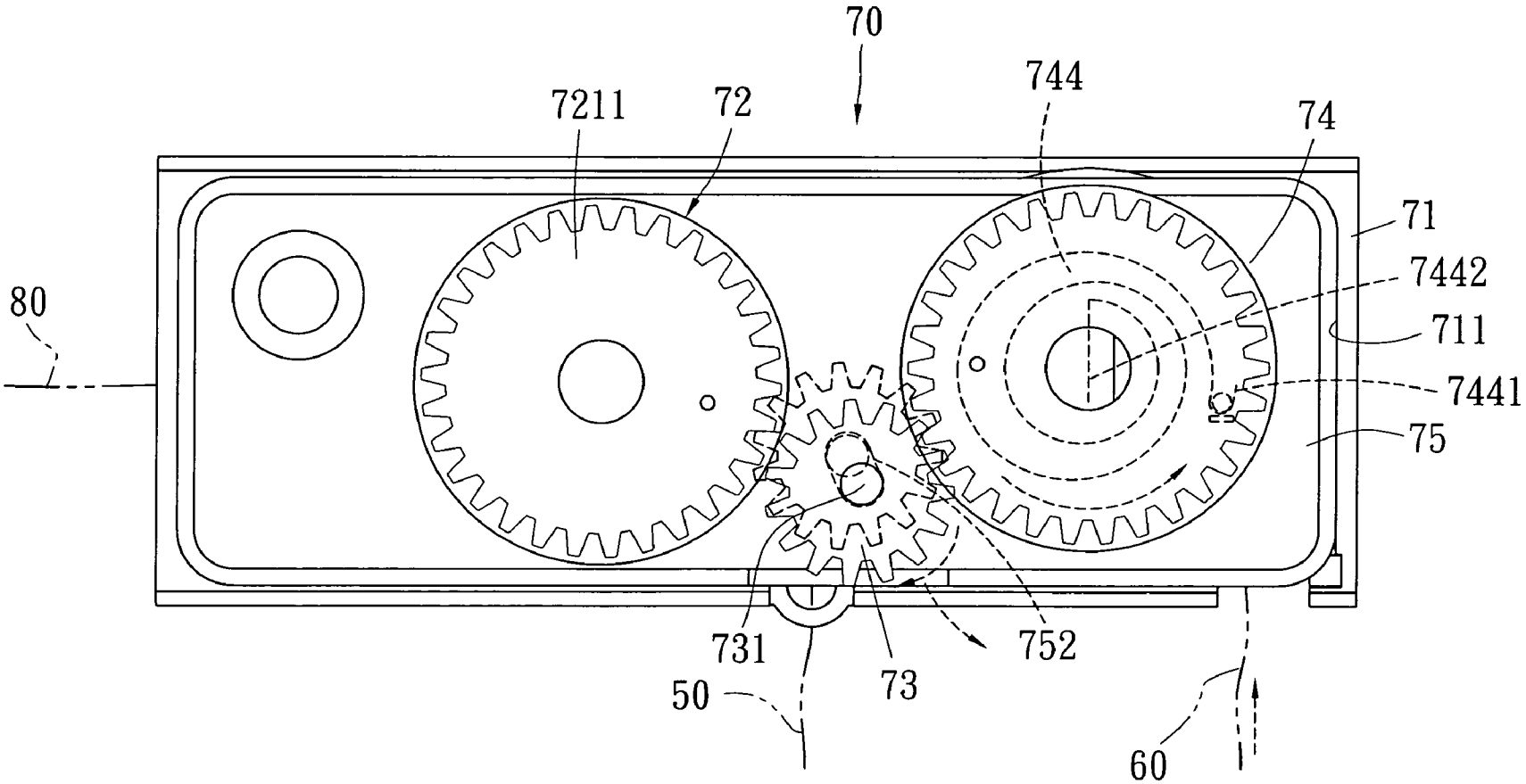
FIG. 8 is a top view of the lift cord retracting and releasing control means for extending the slat assembly.
Figure 9:
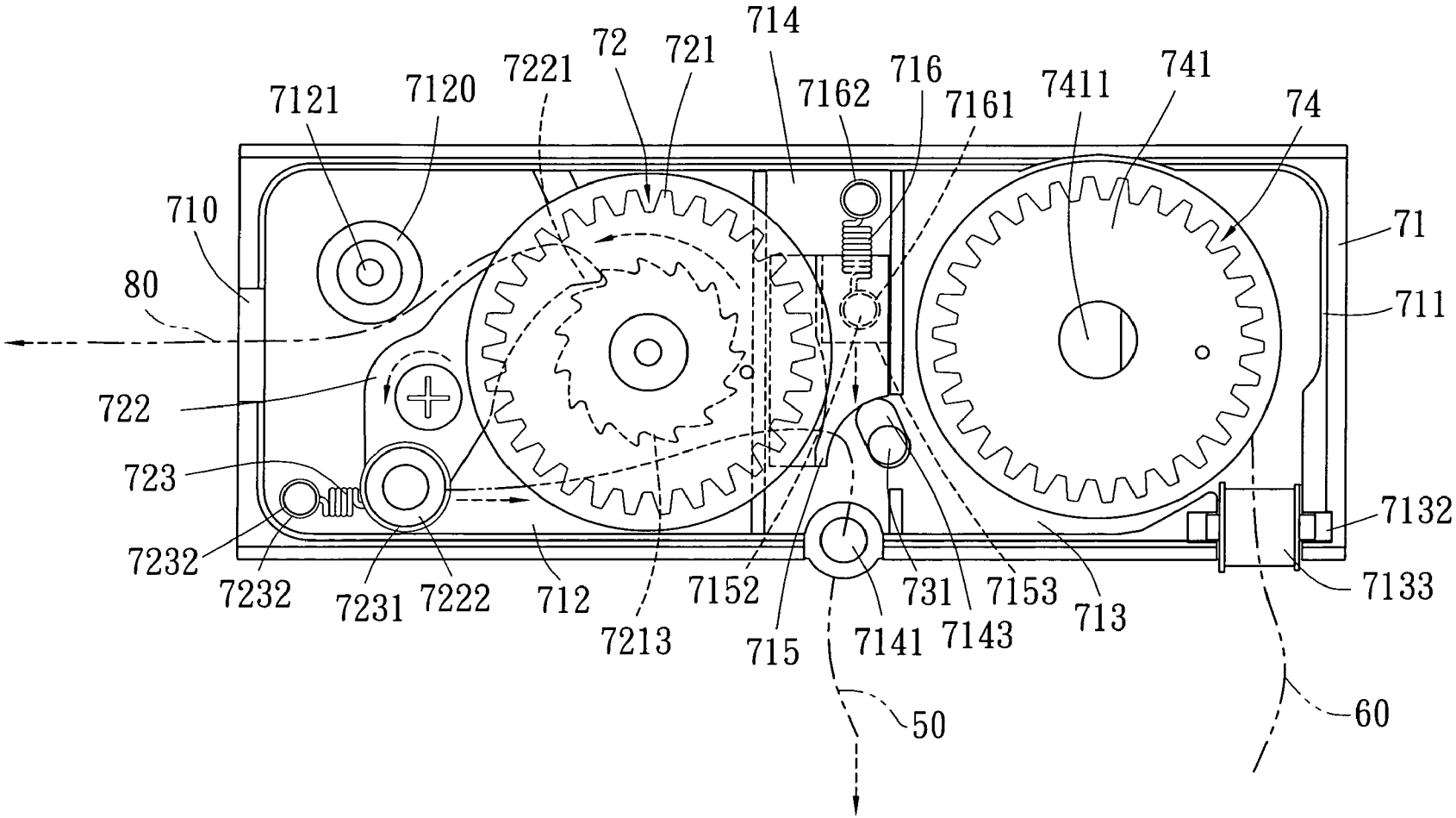
FIG. 9 is another top view of the lift cord retracting and releasing control means for extending the slat assembly.

Referring to FIGS. 7 and 8, when the slat assembly 40 is lowered and extended at a selected elevation, the first lift cord 50 may be pulled downwards to return the driving gear 73 to a lower position so that the ratchet and gear set 72 is separated from the driving ear 73, and the latch end 7221 engaged with the ratchet spool 7213 is moved in the opposite direction and disengaged. Thereby the lift cord means 80 wound by the winding trough 7212 is not latched by the latch end 7221, and can be released and lowered (referring to FIG. 9). Thus the slat assembly 40 also can be lowered and extended at a selected elevation. As a result the indoor luminary condition can be adjusted as desired.

Figure 10:
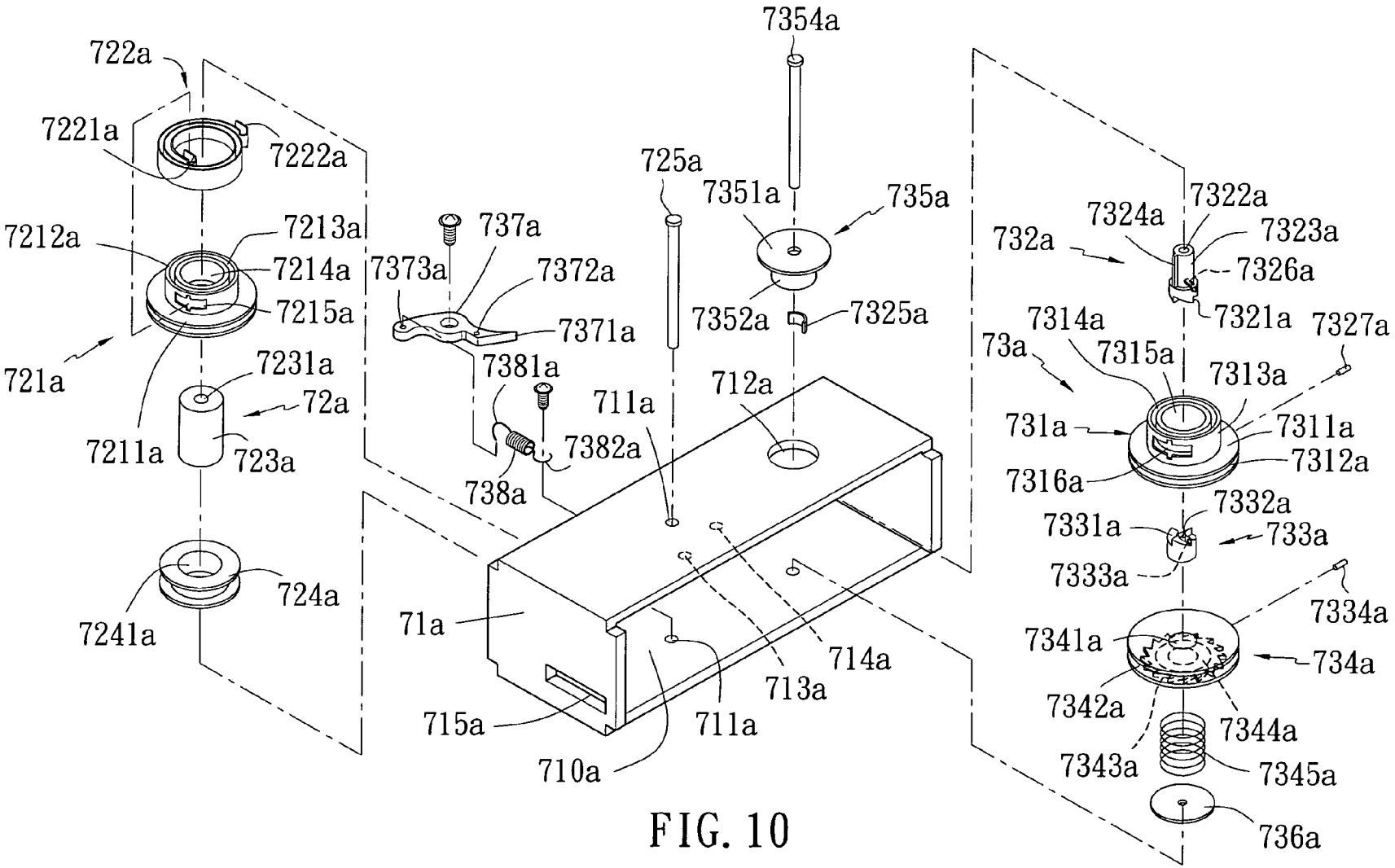
FIG. 10 is an exploded view of another embodiment of the lift cord retracting and releasing control means of the invention.
Figure 11:
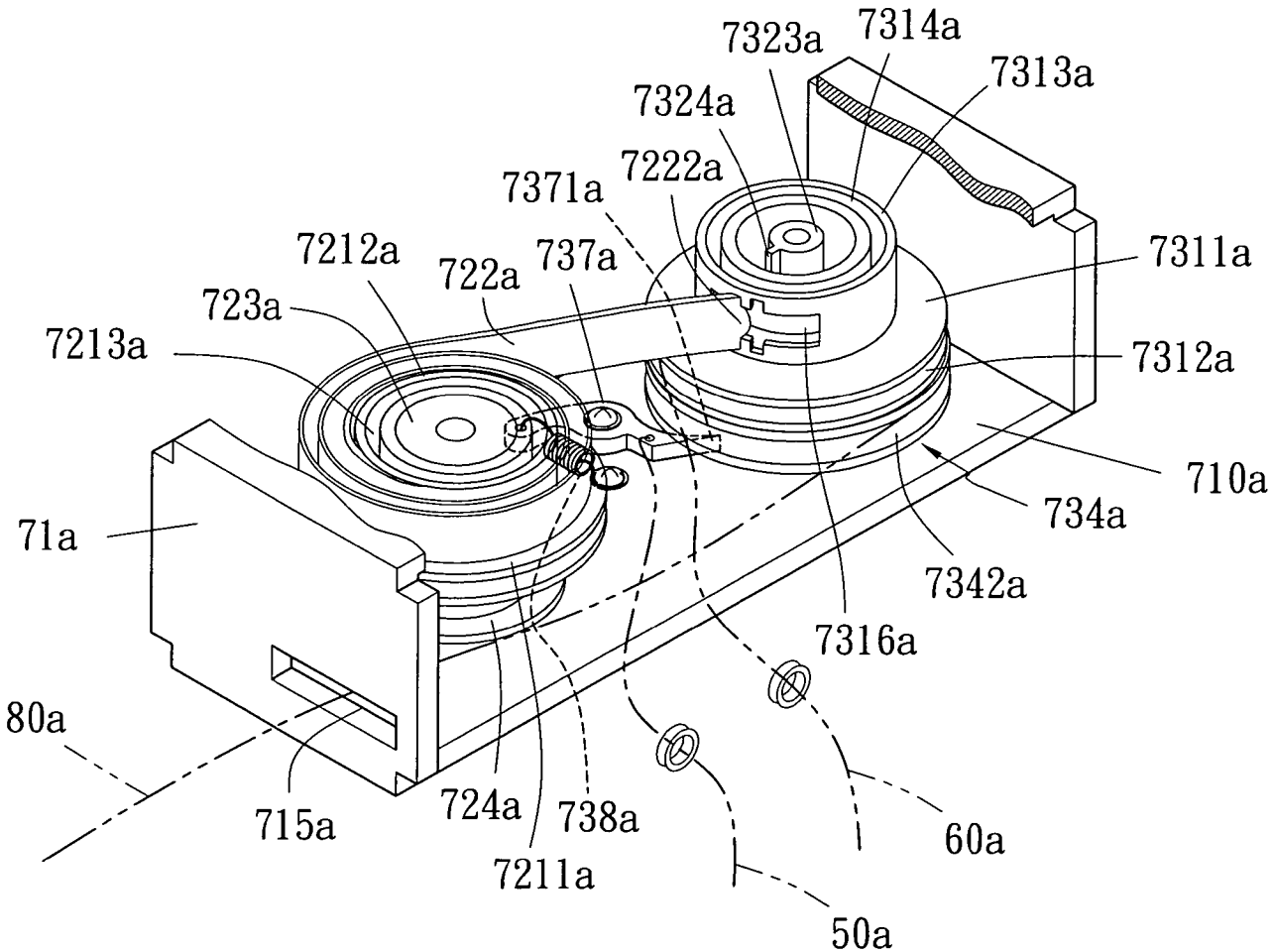
FIG. 11 is a perspective view of another embodiment of the lift cord retracting and releasing control means of the invention.

Referring to FIGS. 10 and 11, the lift cord retracting and releasing control means **70*a* may also include at least a frame 71*a*, an auxiliary spool set 72*a* and a latch spool set 73*a*. The frame 71*a* has a hollow housing chamber 710*a*, axle holes 711*a*, a coupling opening 712*a* and a plurality of apertures including a first aperture 713*a* and a second aperture 714*a* on an upper position and a lower position as depicted in another embodiment shown in the drawings. The frame 71*a* further has an opening 715*a* at one side to allow the lift cord means 80*a* to thread through. The auxiliary spool set 72*a* is pivotally coupled on the axle holes 711*a* and includes at least a winding spool 721*a*, an elastic element 722*a*, an axle sleeve 723*a* and a roller 724*a*. The winding spool 721*a* has a spool seat 7211*a* which has a boss 7212*a* extended from an upper position. The boss 7212*a* has a trough 7213*a* and a through hole 7214*a* running through the center thereof. There is a latch trough 7215*a* formed on the periphery thereof. The elastic element 722*a* is coupled on the boss 7212*a* and has respectively a hook 7221*a* and 7222*a* at an inner end and an outer end to be latched on the latch trough 7215*a* and the latch spool set 73*a*. The axle sleeve 723*a* has an axle hole 7231*a* which is coupled with the through hole 7214***a* and a center hole 7341*a* of the roller 724*a* which has a groove 7242*a* to allow the lift cord means 80*a* to move, and an axle 725*a* is provided to run through the axle hole 7231*a* of the axle sleeve 732*a* and the axle holes 711*a* of the frame 71*a* for anchoring to hinge the auxiliary spool set 72*a* at one side of the frame 71*a*.

Figure 12:
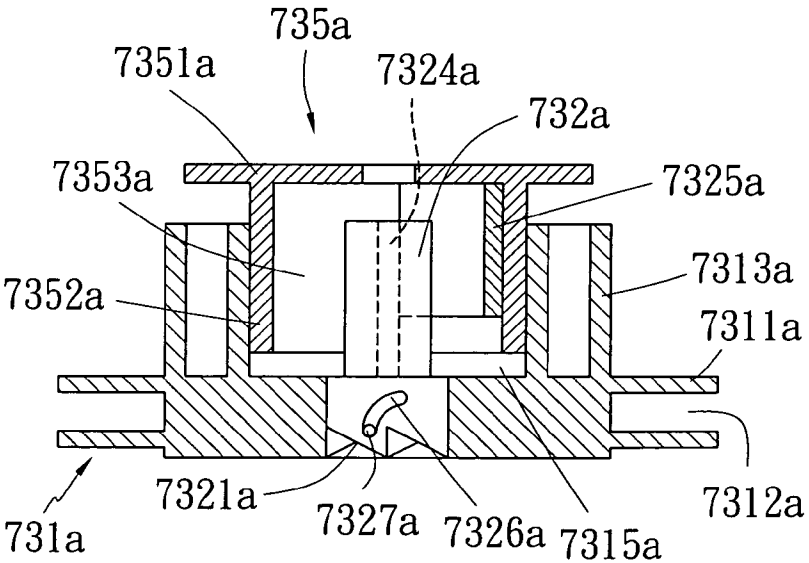
FIG. 12 is a schematic view of the invention showing the winding spool of the latch spool set and the upper axle sleeve in a coupling condition.

Also referring to FIGS. 10, 11 and 12, the latch spool set 73*a* is hinged on the coupling opening 712*a*, and includes at least a winding spool 731*a*, an upper axle sleeve 732*a*, a lower axle sleeve 733*a*, a winding spool 734*a*, an upper coupling member 735*a*, a lower coupling member 736*a*, and a stopper 737*a*. The winding spool 731*a* has a spool seat 7311*a* which has a winding groove 7312*a* to allow the second lift cord 60*a* to wind thereon, and a boss 7313*a* formed thereon. The boss 7313*a* has a trough 7314*a* and a through hole 7315*a* running through the center of the spool seat 7311*a*. There is a latch trough 7316*a* formed on the periphery thereof to be latched by the hook 7222*a* formed at the outer end of the elastic element 722*a*. The upper and lower axle sleeves 732*a* and 733*a* are held in the through hole 7315*a* of the winding spool 731*a* and the winding spool 734*a* that have respectively an engaging portion 7321*a* and 7331*a* at one distal end thereof, and an axle hole 7322*a* and 7332*a* in the center. The upper axle sleeve 732*a* has a latch end 7324*a* at other end that has a shank 7232*a*. The shank 7323*a* is coupled with an arched detent member 7325*a* from an outside and a slant latch trough 7326*a* on a lower half portion to allow a pin 7327*a* to move thereon. The lower axle sleeve 733*a* has a pin hole 7333*a* on the periphery close to the engaging portion 7331*a* to hold an locating bar 7334*a* to fix the lower axle sleeve 733*a* on the winding spool 734*a*. The winding spool 734*a* is located at the bottom of the spool seat 7311*a* and has a coupling opening 7341*a* in the center to hold the lower axle sleeve 733*a*, and a winding groove 7242*a* on the periphery to allow the lift cord means 80*a* to wind thereon, and a ratchet spool 7343*a* at the bottom. The ratchet spool 7343*a* has a recess 7344*a* at one end to hold a spring 7345*a*. The upper coupling member 735*a* is held in the coupling opening 712*a* to allow an axle 7354*a* to run through to anchor the latch spool set 73*a* on another side of the housing chamber 710*a*. The upper coupling member 735*a* further has a detent member 7351*a* at the top and a wedge boss 7352*a* extended from the detent member. The wedge boss 7352*a* has a housing through 7353*a* inside to hold the upper axle sleeve 732*a* coupled with the arched detent member 7325*a*. The lower coupling member 736*a* aims to support the spring 7345*a*. The stopper 737*a* is hinged on the second aperture 714*a* and has a latch end 7371*a* at one end engaged with the ratchet spool 7343*a* at the bottom of the winding spool 734*a*. It has a threading hole 7372*a* close to the latch end 7371*a* to fasten the first lift cord 50*a* and an opening 7373*a* at other end to be latched by one end 7381*a* of an elastic element 738*a*. The elastic element 738*a* has another end 7382*a* latched on the second aperture 714*a*. By means of the elastic element 738*a*, the stopper 737*a* can be swiveled about one point so that when the first lift cord 50*a* is pulled the latch end 7371*a* is moved in the opposite direction.

Figure 13:
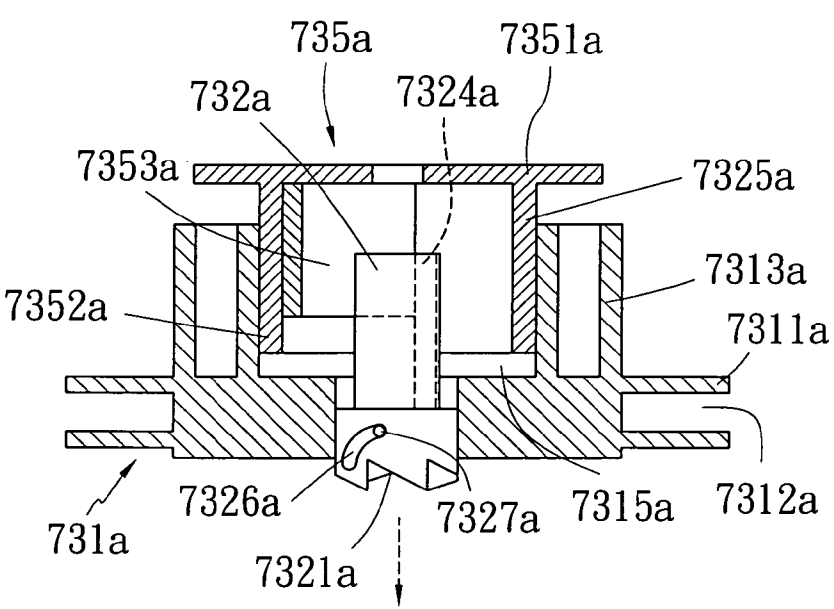
FIG. 13 is a schematic view of the invention showing the upper axle sleeve of the latch spool set moving in a downward condition.
Figure 14:
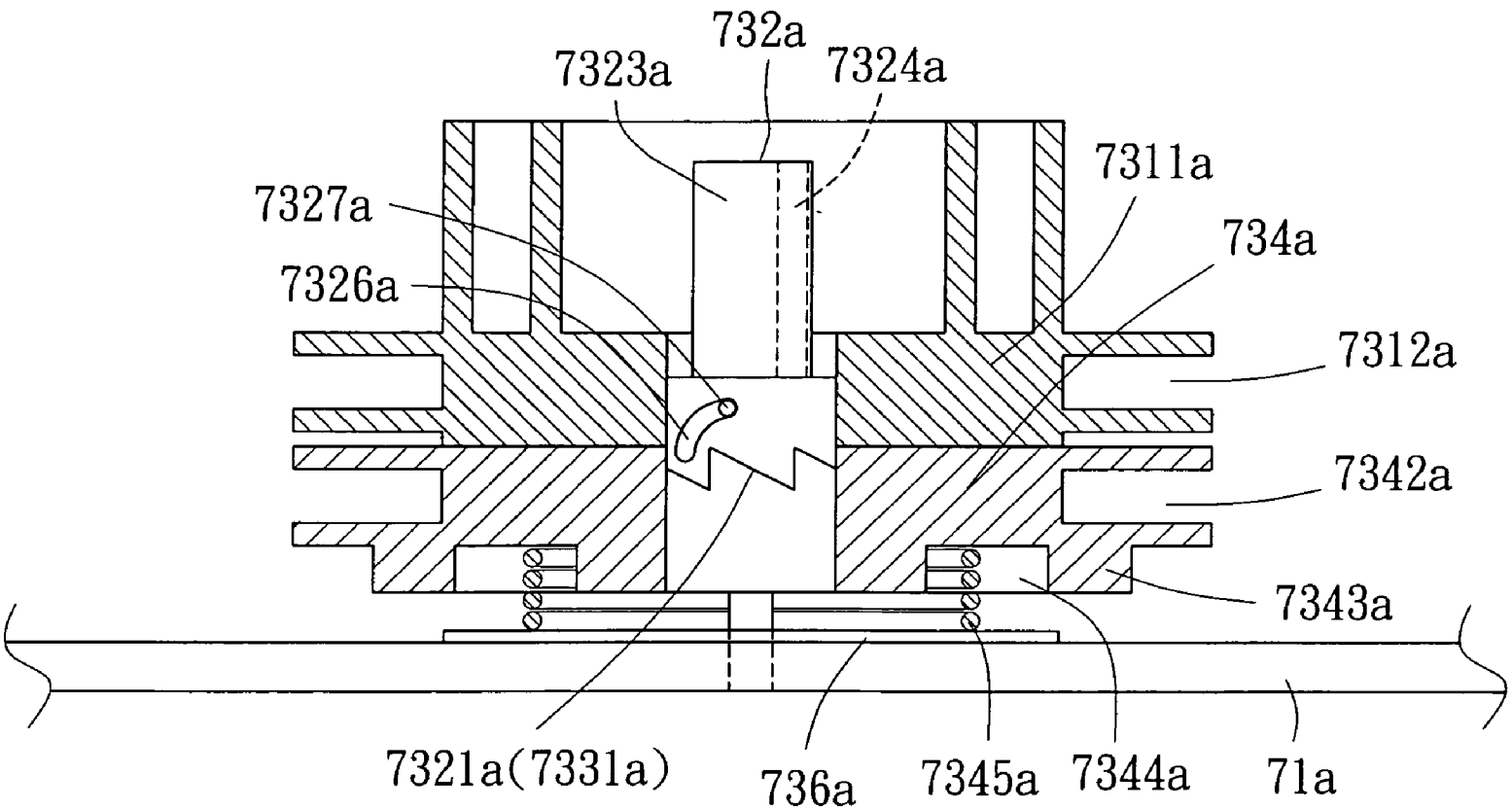
FIG. 14 is a schematic view of the invention showing the upper and lower axle sleeves of the latch spool set in a coupling condition.
Figure 15:
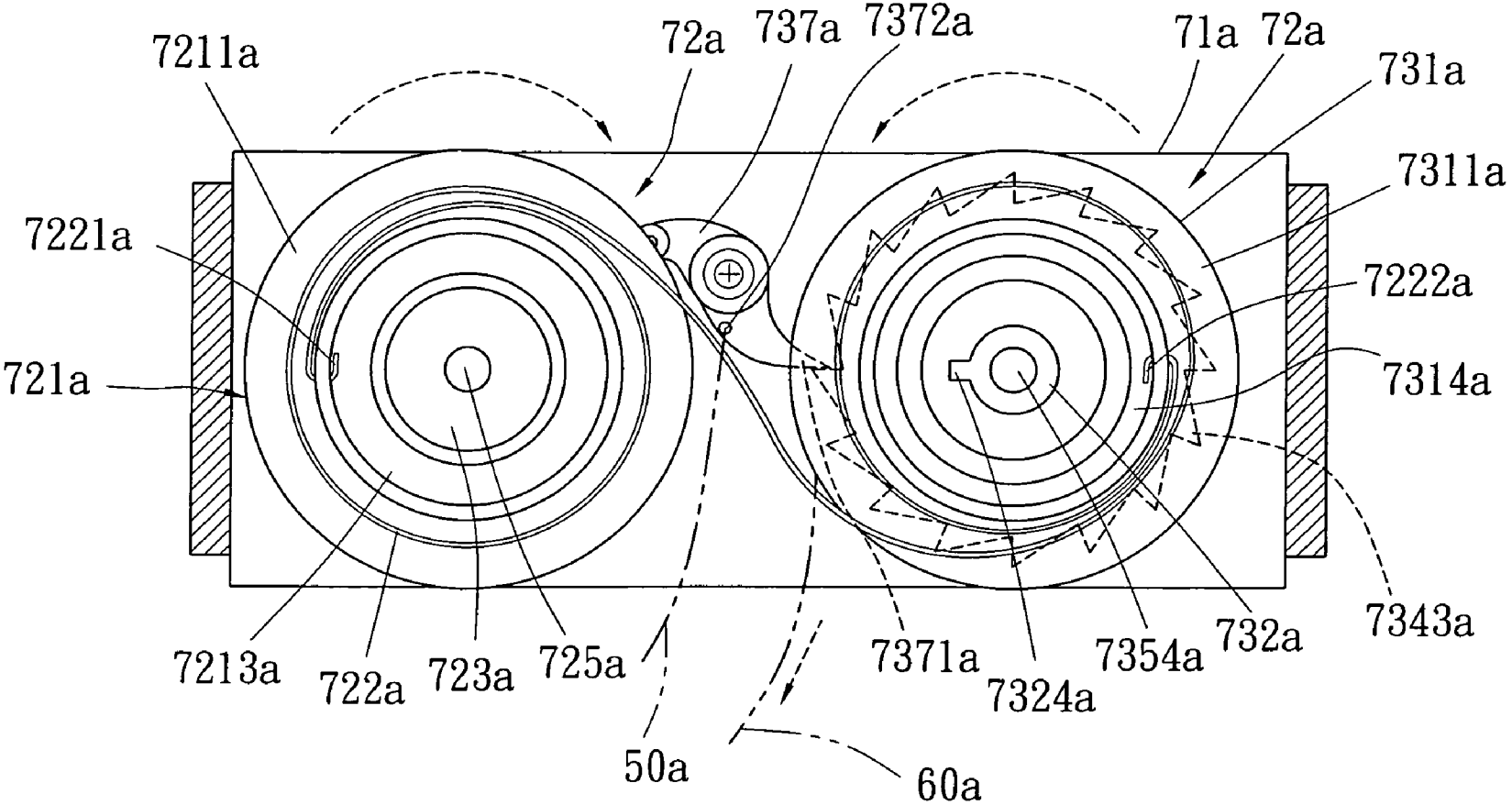
FIG. 15 is a top view of the lift cord retracting and releasing control means for retracting the slat assembly.
Figure 16:
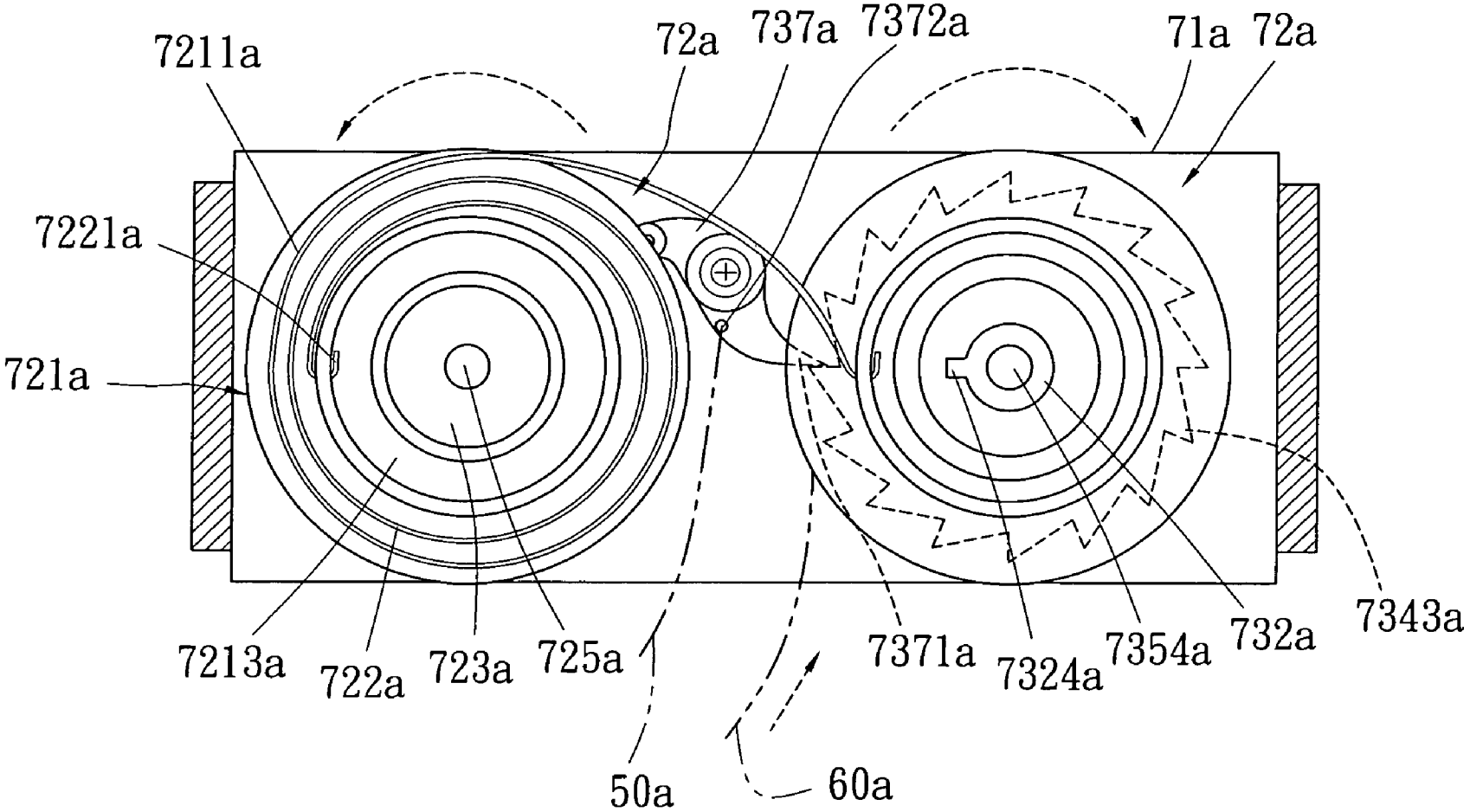
FIG. 16 is another top view of the lift cord retracting and releasing control means for retracting the slat assembly.

Referring to FIGS. 12, 13 and 14, when the window coverings 10 is in use and the slat assembly 40 is retracted, pull the second lift cord 60*a* downwards, the winding spool 721*a* of the auxiliary spool set 72*a* is wound and engaged with the winding spool 731*a* of the latch spool set 73*a* through the elastic element 722*a*. When the winding spool 731*a* is moved counterclockwise the second lift cord 60*a* also is wound thereon. The upper axle sleeve 732*a* coupled on the winding spool 731*a* is moved downwards through the slant trough 7326*a* to drive the engaged winding spool 734*a* held on the lower axle sleeve 733*a* to wind the lift cord means 80*a*. Meanwhile the upper axle sleeve 732*a* is rotated to drive the arched detent member 7325*a* until it is stopped at the latch end 7324*a*. Through the latch end 7371*a* at one end of the stopper 737*a* and the ratchet spool 7343*a* at the bottom of the winding spool 734*a*, a latched condition is formed. Hence the lift cord means 80*a* winding on the winding spool 734*a* is wound in the same direction as the winding spool 731*a* does. Namely when the second lift cord 60*a* is pulled once, the slat assembly 40 can be retracted upwards to a desired elevation. When the pulling force is released, the second lift cord 60*a* returns through the elastic force of the elastic element 722*a* already wound on the winding spool 731*a* (referring to FIGS. 15 and 16).

Figure 17:
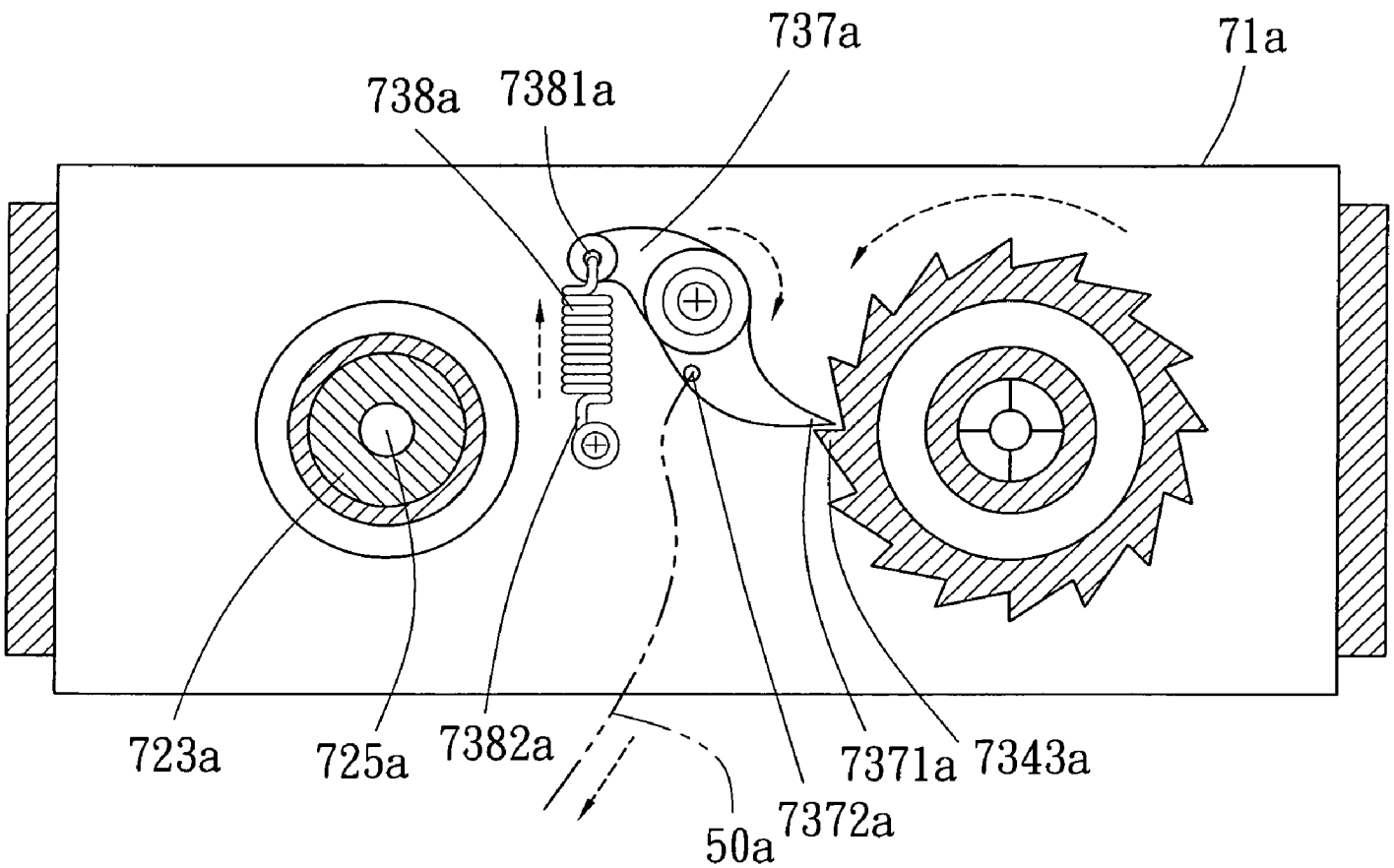
FIG. 17 is a top view of the first lift cord for extending the slat assembly.

Referring to FIGS. 14 and 17, when the slat assembly 40 is extended and lowered to a selected elevation, pull the first lift cord 50*a* downwards, the latch end 7371*a* at one end of the stopper 737*a* escapes the ratchet spool 7343*a*, the lift cord means 80*a* wound on the winding groove 7342*a* of the winding spool 734*a* is not latched by the latch end 7371*a* of the stopper 737*a*. Hence the lift cord means 80*a* on the winding groove 7342*a* is lowered to allow the slat assembly 40 to be extended at the selected elevation. As a result users can adjust the indoor luminary condition as desired.

Figure 18:
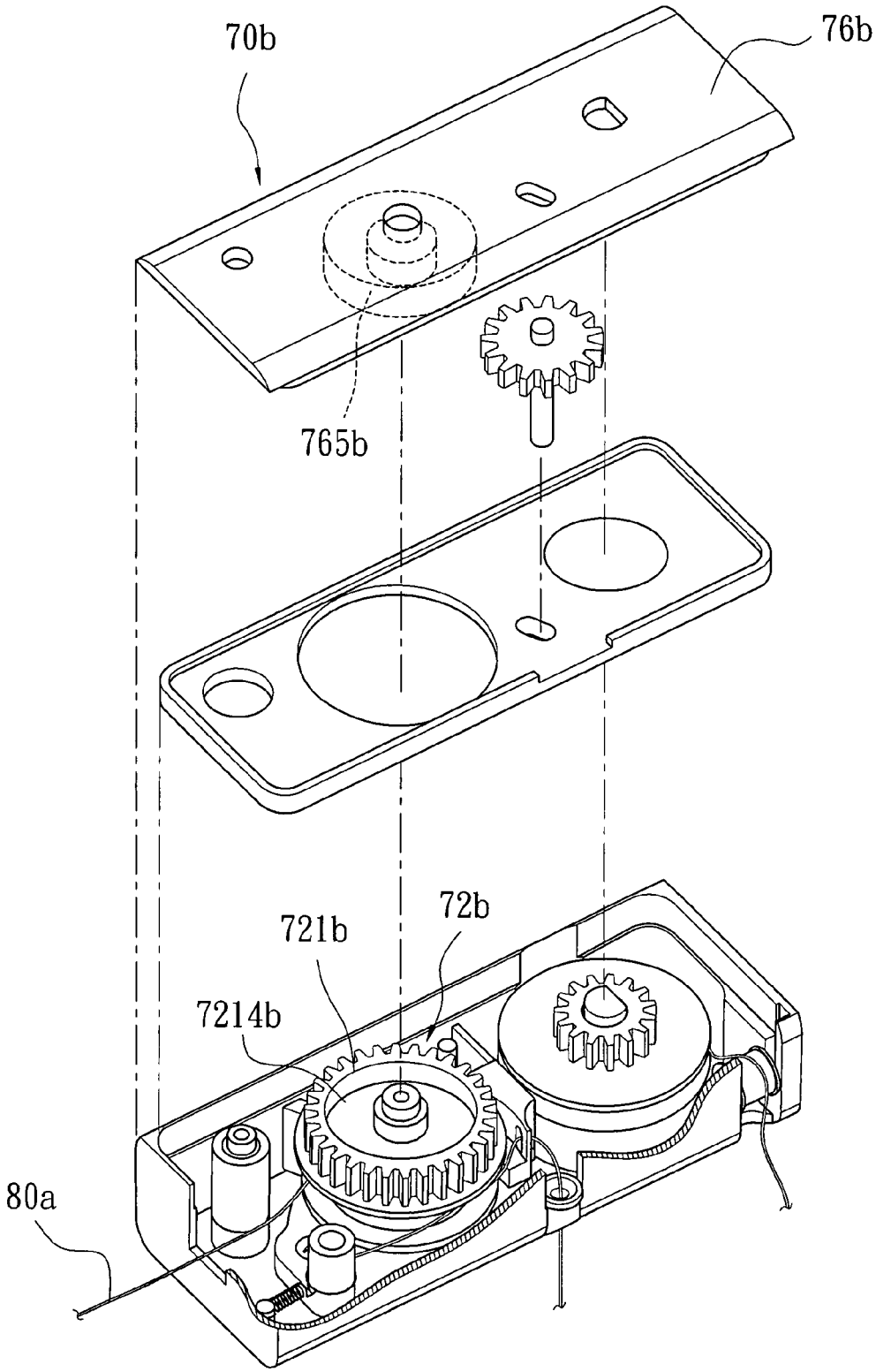
FIG. 18 is an exploded view of yet another embodiment of the lift cord retracting and releasing control means of the invention.
Figure 19:
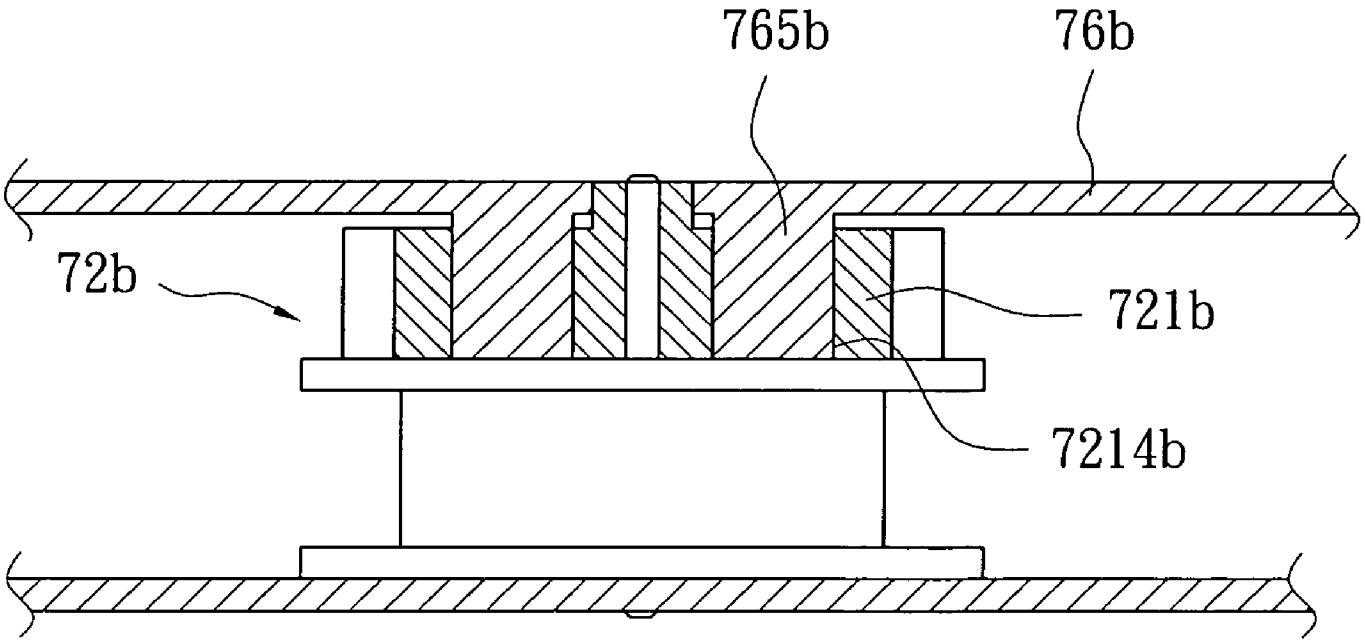
FIG. 19 is a schematic view according to FIG. 18 in an assembled condition.

Refer to FIGS. 18 and 19 for yet another embodiment of the invention. The winding spool 721*a* of the lift cord retracting and releasing control means 70*b* has a housing chamber 7214*b*. An upper lid 76*b* is provided corresponding to the housing chamber and has a tenon 765*b* engaged with the housing chamber 7214*b* through a lubricant. Thus the lift cord means 80*a* can be retracted and released smoothly.

What is claimed is:

1. A window coverings, comprising at least:

an upper elongated member;

a lower elongated member spaced from the upper elongated member at a lower position;

a slat assembly which has slats and a lift cord means and an upper end of the slat assembly fastened to the upper elongated member and a lower end of the slat assembly fastened to the lower elongated member;

a lift cord winding and releasing control means located on the upper elongated member;

a first lift cord to control the lower elongated member to be extended downwards in a constant fashion having one end fastened to the lift cord winding and releasing control means and other end threading through the upper elongated member; and a second lift cord to control the lower elongated member to be retracted upwards in a staged fashion having one end fastened and wound around the lift cord winding and releasing control means and other end threading through the upper elongated member;

wherein the lift cord winding and releasing control means includes a ratchet and gear set wound by the lift cord means, an auxiliary gear set wound by the second lift cord, a movable member and a driving gear respectively disposed between the ratchet and gear set and the auxiliary gear set, the driving gear is moved by the movable member to engage with the ratchet gear set and the auxiliary gear set to enable the ratchet and gear set rotating with the auxiliary gear set simultaneously.

2. The window coverings of claim 1, wherein the movable member has an aperture at one end; a locating bar and a trough on a bottom end, wherein the trough holding a spring.

3. The window coverings of claim 1, wherein the ratchet and gear set includes at least a winding spool, a stopper and an elastic element.

4. The window coverings of claim 3, wherein the winding spool is coupled on a shaft and has a gear on a upper end, a winding trough at a middle portion and a ratchet spool at a lower end, the winding trough being wound by the lift cord means.

5. The window coverings of claim 3, wherein the stopper is pivotally coupled on an anchor post and has a latch end at one end to form a latch condition with the ratchet spool and a boss at another end.

6. The window coverings of claim 5, wherein the elastic element has one end latched on the boss of the stopper and other end coupled on a strut.

7. The window coverings of claim 1, wherein the driving spool has a first axle run through the center that is movable in a slant rectangular opening.

8. The window coverings of claim 1, wherein the auxiliary gear set has a gear which has a winding trough at a middle portion and a groove on a lower end to hold an elastic element.

9. The window coverings of claim 1, wherein the lift cord winding and releasing control means has an auxiliary spool set and a latch spool set.

10. The window coverings of claim 9, wherein the auxiliary spool set includes at least a winding spool, an elastic element coupled on a boss of a spool seat, an axle sleeve and a roller.

11. The window coverings of claim 10, wherein the winding spool has a spool seat which has a boss formed thereon, the boss having a trough and a through hole running through the center of the spool seat and a latch trough formed on the periphery thereof.

12. The window coverings of claim 10, wherein the axle sleeve has an axle hole and is held in the through hole of the spool seat and in a center hole of the roller which has a groove.

13. The window coverings of claim 9, wherein the latch spool set includes at least a winding spool, a upper axle sleeve, a lower axle sleeve, a winding spool, a upper coupling member, a lower coupling member and a stopper.

14. The window coverings of claim 13, wherein the winding spool has a spool seat which has a winding groove for winding the second lift cord and a boss formed thereon, the boss having a trough and a through hole running through the center of the spool seat, and a latch trough formed on the periphery thereof to latch an outer end of an elastic element.

15. The window coverings of claim 13, wherein the upper axle sleeve and the lower axle sleeve are located in the through hole of the winding spool and the winding spool, and have respectively a portion engaged with each other and an axle hole in the center thereof, the upper axle sleeve having a shank at other end that has a latch end, the periphery of the shank being coupled with an arched detent member and having a slant latch trough at a lower half portion to allow a pin to move therein, the lower axle sleeve having a pin hole on the periphery close to the engaging portion to receive an locating bar to fix the lower axle sleeve on the winding spool.

16. The window coverings of claim 13, wherein the winding spool is located at the bottom of the winding spool and has a coupling opening in the center to hold the lower axle sleeve and a winding groove on the periphery to wind the lift cord means, and a ratchet spool at the bottom that has a recess at one end to hold a spring.

17. The window coverings of claim 13, wherein the upper coupling member is held in a coupling opening and has a flange at the top and a wedge boss extended at a lower position that has a housing trough.

18. The window coverings of claim 13, wherein the lower coupling member supports a spring.

19. The window coverings of claim 13, wherein the stopper is pivotally held in the second aperture and has a latch end at one end engaged with a ratchet spool located at the bottom of the winding spool, a hole close to the latch end to fasten to the first lift cord and an opening at another end to latch one end of an elastic element.

* * * * *